US011287209B2

(12) United States Patent
Peacemaker et al.

(10) Patent No.: US 11,287,209 B2
(45) **Date of Patent: *Mar. 29, 2022**

(54) DUAL STAGE COMPOUND BOW

(71) Applicant: SOS Solutions, Inc., Tonasket, WA (US)

(72) Inventors: Samuel R. Peacemaker, Gilbert, AZ (US); Benjamin Peacemaker, Chandler, AZ (US)

(73) Assignee: SOS Solutions, INC., Tonasket, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/993,008

(22) Filed: Aug. 13, 2020

(65) Prior Publication Data

US 2020/0370855 A1 Nov. 26, 2020

Related U.S. Application Data

(63) Continuation of application No. 16/590,624, filed on Oct. 2, 2019, now Pat. No. 10,775,126, which is a continuation of application No. 16/235,786, filed on Dec. 28, 2018, now Pat. No. 10,473,417.

(51) Int. Cl.
*F41B 5/10* (2006.01)

(52) U.S. Cl.
CPC ..... *F41B 5/105* (2013.01); *F41B 5/10* (2013.01)

(58) Field of Classification Search
CPC ..... F41B 5/10; F41B 5/105
See application file for complete search history.

(56) References Cited

U.S. PATENT DOCUMENTS

| | | | | |
|---|---|---|---|---|
| 3,726,459 | A | 4/1973 | Defontenay | |
| 3,782,208 | A | 1/1974 | Hacker | |
| 3,977,263 | A | 8/1976 | Nara | |
| 4,425,988 | A | 1/1984 | Stock | |
| 4,478,202 | A | 10/1984 | Anderson | |
| 4,757,799 | A | 7/1988 | Bozek | |
| 4,903,677 | A | 2/1990 | Colley | |
| 5,454,277 | A | 10/1995 | Imase | |
| 5,950,609 | A | 9/1999 | Thielen | |
| 6,629,522 | B2 * | 10/2003 | Andrews | F41B 5/10 124/25.6 |
| 8,893,694 | B1 | 11/2014 | DeBole | |
| 9,157,693 | B1 | 10/2015 | DeBole | |
| 9,470,471 | B2 | 10/2016 | DeBole | |
| 10,473,417 | B1 * | 11/2019 | Peacemaker | F41B 5/105 |
| 10,775,126 | B2 * | 9/2020 | Peacemaker | F41B 5/10 |
| 2013/0061839 | A1 | 3/2013 | Asherman | |

OTHER PUBLICATIONS

USPTO; Notice of Allowance dated Sep. 11, 2019 in U.S. Appl. No. 16/235,786.
USPTO; Notice of Allowance dated May 15, 2020 in U.S. Appl. No. 16/590,624.

* cited by examiner

*Primary Examiner* — John A Ricci
(74) *Attorney, Agent, or Firm* — Snell & Wilmer L.L.P.

(57) ABSTRACT

The present disclosure provides for a cam assembly, the cam assembly comprising a shoot cam and a charge cam. The shoot cam is configured to be operatively coupled to the charge cam. The cam assembly is configured to store a potential energy in response to a draw of a drawstring.

20 Claims, 11 Drawing Sheets

DUAL STAGE COMPOUND BOW

CROSS-REFERENCE TO RELATED APPLICATIONS

This application is a continuation application of and claims priority to U.S. patent application Ser. No. 16/590,624, entitled "DUAL STAGE COMPOUND BOW," and filed on Oct. 2, 2019, which is a continuation application of and claims priority to U.S. patent application Ser. No. 16/235,786, entitled "DUAL STAGE COMPOUND BOW," and filed on Dec. 28, 2018. The '624 and '786 applications are incorporated herein by reference in their entirety.

FIELD OF THE DISCLOSURE

The present disclosure relates to a compound bow system, and more specifically, to a dual stage compound bow system.

BACKGROUND OF THE DISCLOSURE

Conventional compound bow systems utilize a plurality of cables and cams to store energy in the limbs of the compound bow, which may be released to launch a projectile such as an arrow. Typically, the cams are configured to rotate in response to a user pulling a drawstring, thereby charging the bow limbs to achieve an adequate output force to launch the arrow at an intended velocity. However, in some cases, the force required to fully charge the compound bow by pulling the drawstring to a fully drawn position may be too great for some users. Accordingly, it may be desirable to have a mechanism capable of reducing the draw weight of the compound bow, without adversely affecting the output energy of the bow.

SUMMARY OF THE DISCLOSURE

A cam assembly for a compound bow is disclosed, comprising a shoot cam and a charge cam configured to be operatively coupled to the shoot cam, wherein the cam assembly is configured to store a potential energy in response to a draw of a drawstring.

In various embodiments, the cam assembly further comprises a charge cam pawl configured to contact a notch in the charge cam.

In various embodiments, the cam assembly further comprises a charge cam pawl rod coupled to the charge cam pawl and configured to contact a charge cam pawl unlocking component to disengage the charge cam pawl from the charge cam.

In various embodiments, the cam assembly further comprises a spring arm configured to contact the charge cam pawl and configured to urge the charge cam pawl to an engaged position with respect to the charge cam.

In various embodiments, the cam assembly further comprises a ball detent coupled to the charge cam pawl and configured to urge the charge cam pawl to a disengaged position with respect to the charge cam.

In various embodiments, the charge cam pawl unlocking component is configured to force the charge cam pawl rod radially outward to disengage the charge cam pawl from the charge cam.

In various embodiments, the cam assembly further comprises a charge cam cable, wherein the charge cam is configured to be operatively coupled to the shoot cam via the charge cam cable.

In various embodiments, the cam assembly further comprises a fixed keyed plate, wherein the shoot cam and the charge cam are configured to rotate in a common direction with respect to the fixed keyed plate.

In various embodiments, the cam assembly further comprises a plurality of roller elements coupled to the fixed keyed plate, wherein the plurality of roller elements is configured to allow the charge cam cable to move relative to the fixed keyed plate.

A compound bow is disclosed, comprising a cam assembly comprising a shoot cam operatively coupled to a charge cam, wherein the cam assembly is configured to store a potential energy in response to a draw of a drawstring.

In various embodiments, the compound bow further comprises a charge cam cable.

In various embodiments, the charge cam is operatively coupled to the shoot cam via the charge cam cable.

In various embodiments, the compound bow further comprises a fixed keyed plate.

In various embodiments, the shoot cam and the charge cam are configured to rotate with respect to the fixed keyed plate.

In various embodiments, the compound bow further comprises a plurality of roller elements coupled to the fixed keyed plate.

In various embodiments, the charge cam cable is wrapped around the plurality of roller elements.

In various embodiments, the compound bow further comprises a drawstring coupled to the cam assembly and configured to rotate the cam assembly to store the potential energy.

A compound bow is disclosed, comprising a shoot cam and a charge cam operatively coupled to the shoot cam, wherein the charge cam is configured to rotate to a locked position to store a potential energy in response to a draw of a drawstring.

In various embodiments, the compound bow further comprises a charge cam cable.

In various embodiments, a first end of the charge cam cable is coupled to the shoot cam and a second end of the charge cam cable is cabled to the charge cam.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

Figure 1:
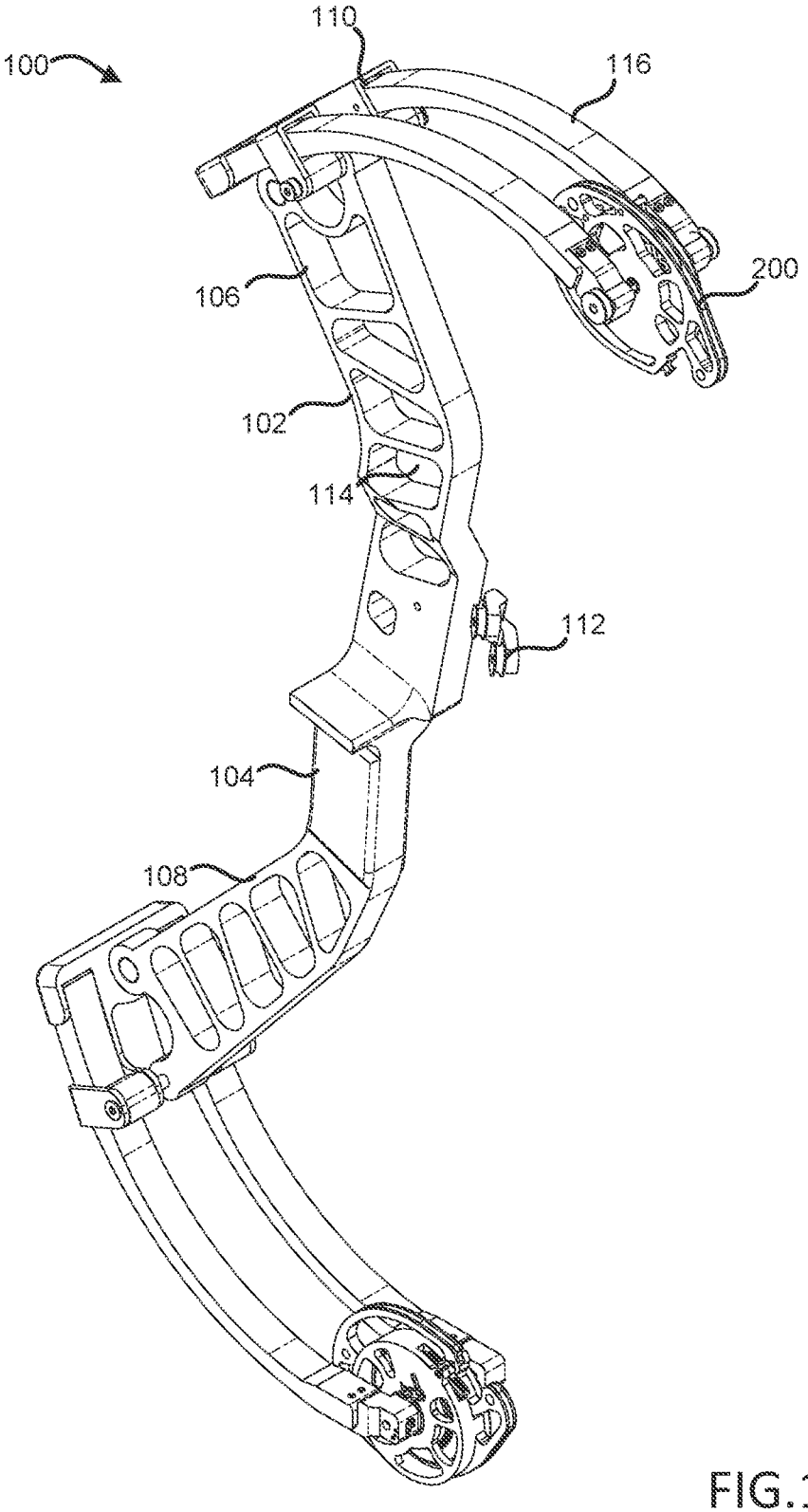
FIG. 1 illustrates a perspective view of a dual stage compound bow, in accordance with various embodiments.
Figure 2A:
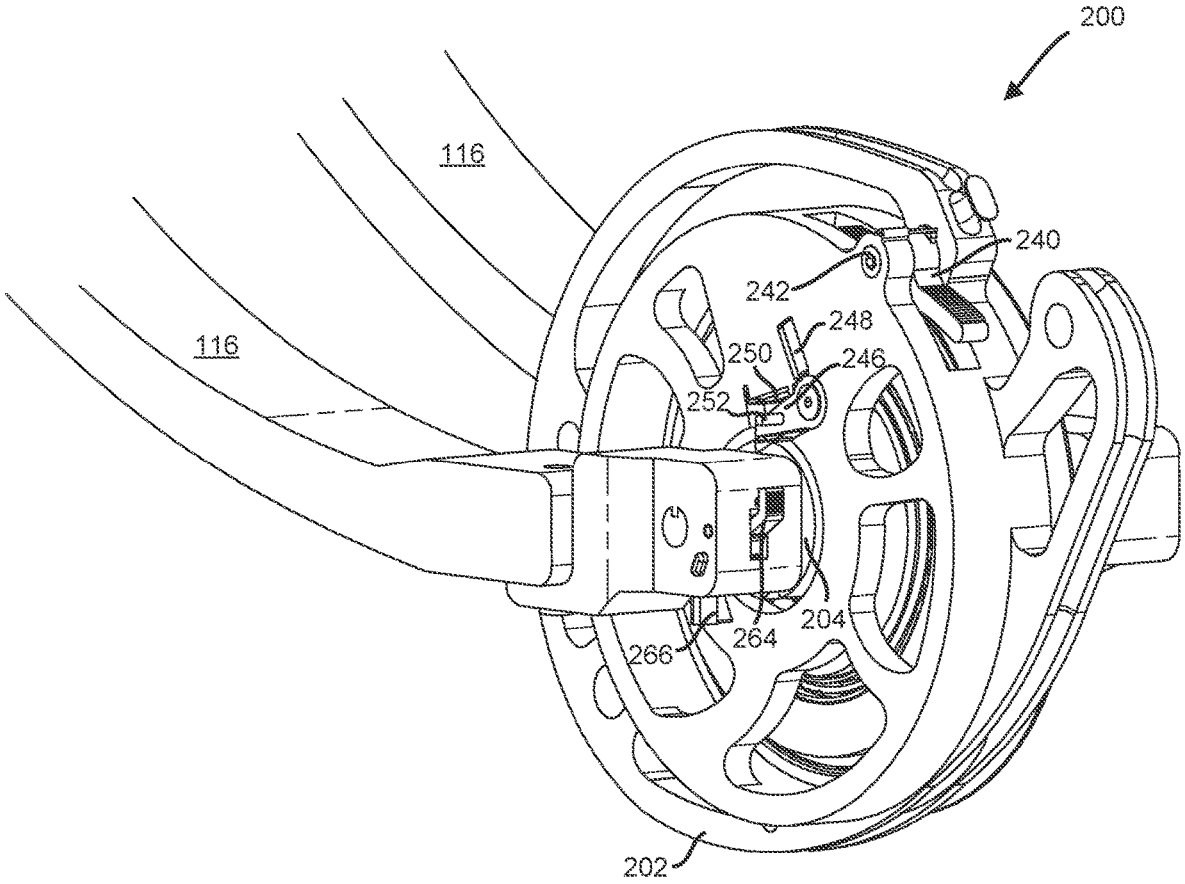
FIG. 2A illustrates a perspective view of a dual stage cam assembly from a first angle, in accordance with various embodiments.
Figure 2B:
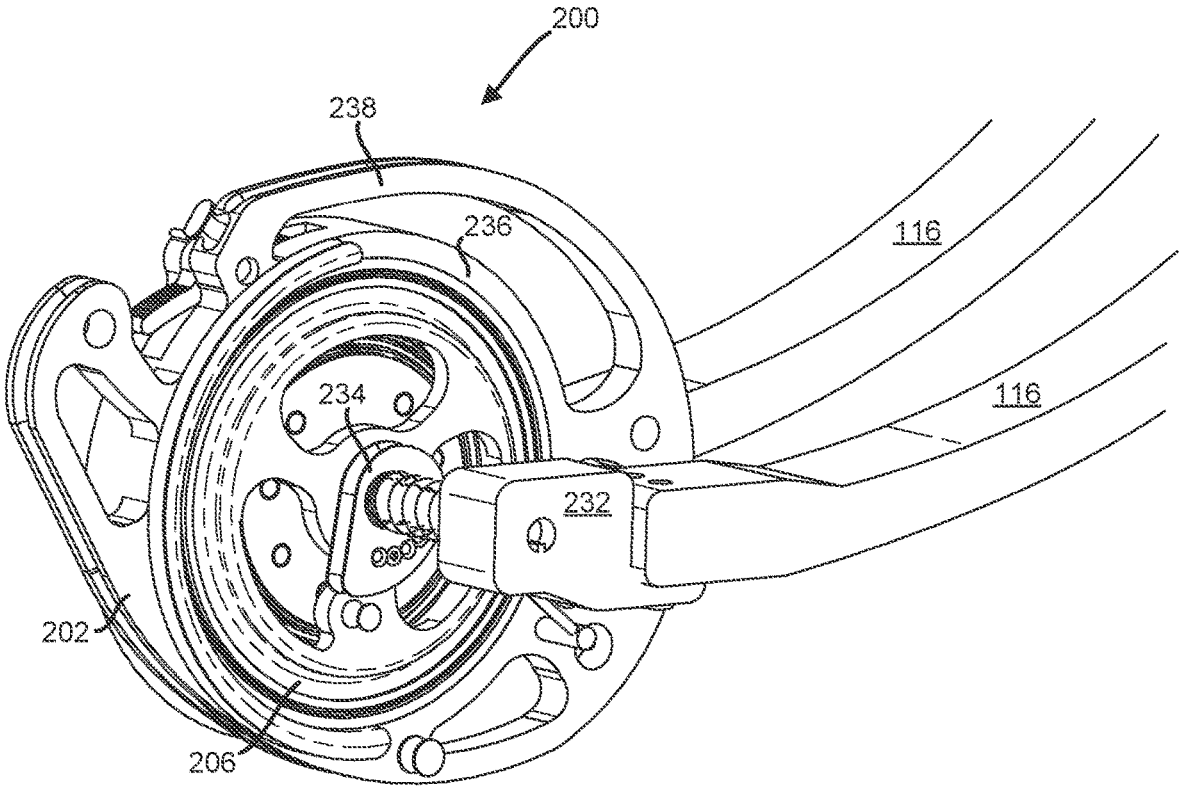
FIG. 2B illustrates a perspective view of a dual stage cam assembly from a second angle, in accordance with various embodiments.
Figure 3:
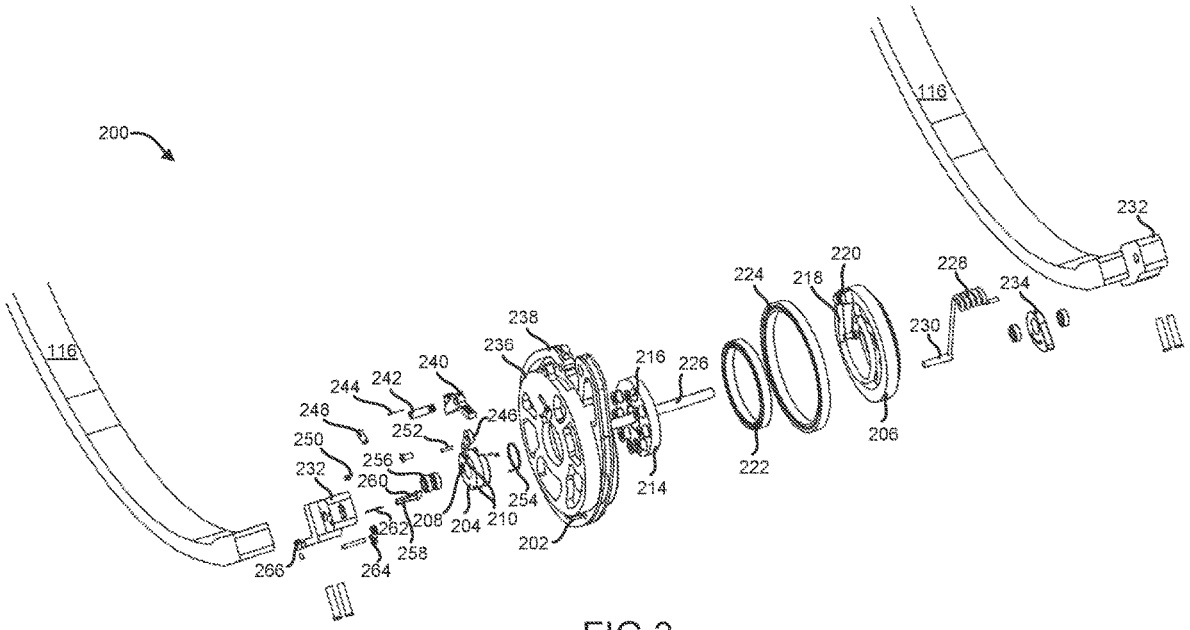
FIG. 3 illustrates an exploded view of a dual stage cam assembly, in accordance with various embodiments.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, electrical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, methods, systems, and articles may find particular use in connection with compound bows. However, various aspects of the disclosed embodiments may be adapted for performance in a variety of other mechanical systems. As such, numerous applications of the present disclosure may be realized.

Conventional compound bows include one or more cam assemblies configured to provide a mechanical advantage for a user pulling the drawstring of the compound bow. Typically, the output force of the compound bow is directly dependent on the amount of force required to bring the drawstring to a fully drawn position. In general, as the drawstring is pulled, cams mounted on opposing limbs of the compound bow rotate, thereby flexing the limbs and storing energy in the bow. The shape and orientation of the cams is configured to provide a mechanical advantage to a user pulling the drawstring. However, as the drawstring continues to be pulled toward a fully drawn position, the mechanical advantage provided by the rotating cam system decreases and it becomes more and more difficult for the user to finish the pull to achieve maximum output force and maximum output velocity of the arrow.

Accordingly, users incapable or unwilling of pulling the drawstring to a fully drawn position may gravitate towards use of compound bows capable of less output force, thereby resulting in lower velocity arrows. Lower velocity arrows may be detrimental for applications such as hunting, where low arrow velocities may result in the target animal being wounded rather than killed, for example. This problem may be exacerbated in younger or older users who may lack the strength to fully draw the bow. In various embodiments, a dual stage compound bow is provided that allows for a reduced draw weight relative to the output force of the bow.

Accordingly, with reference to FIG. 1, a perspective view of a dual stage compound bow 100 is illustrated, in accordance with various embodiments. Dual stage compound bow 100 may comprise a central body 102 comprising a grip 104, a first member 106, and a second member 108, and one or more limb pockets 110 positioned at terminal ends of first member 106 and second member 108. Central body 102 may be configured to receive one or more bow components, including limbs, sights, stabilizer bushings, or other components. For example, in various embodiments, one or more cable rollers 112 may be coupled to central body 102 and configured to guide buss cables 118 (with momentary reference to FIGS. 5-9). Central body 102 may comprise one or more cutouts 114 configured to reduce a weight of dual stage compound bow 100. Limb pockets 110 may be configured to receive a corresponding number of limbs 116. While illustrated with respect to a split limb bow comprising two separate pairs of limbs 116 coupled to and extending from central body 102, dual stage compound bow 100 is not limited in this regard and may comprise any suitable number of limbs 116 coupled to central body 102.

In various embodiments, dual stage compound bow 100 may comprise various materials. For example, central body 102 may comprise an aluminum, aluminum alloy, composite material, or other suitable material. Limbs 116 may comprise a composite material or another resilient material capable releasing stored energy when elastically deformed and releasing such energy when returning to a nondeformed state.

In various embodiments, dual stage compound bow 100 may comprise one or more dual stage cam assemblies 200. As will be discussed further herein, dual stage cam assemblies 200 may be configured to rotate in response to a user pulling a drawstring 120 (with momentary reference to FIGS. 5-9) connected to dual stage cam assemblies 200, thereby tensioning one or more of the buss cables 118 connecting limbs 116 and dual stage cam assemblies 200. While illustrated with respect to having two dual stage cam assemblies 200, dual stage compound bow 100 is not limited in this regard and may comprise any suitable number of cams. For example, dual stage compound bow 100 may comprise a single cam, hybrid cam, dual cam, binary cam, quad cam, or hinged cam, in accordance with various embodiments.

Drawstring 120 may be configured to be coupled to one or more dual stage cam assemblies 200 and coupled on a second end to a second dual stage cam assembly 200. Drawstring 120 may comprise any suitable material, including but not limited to high-modulus polyethylene, polyester, natural materials, plastic-coated steel, or any other material comprising high tensile strength, yet low elasticity. In various embodiments, dual stage compound bow 100 may comprise two buss cables 118, however, is not limited in this regard. Each buss cable 118 may be connected to a limb 116 on one end and to a dual stage cam assembly 200 on the other. In various embodiments, each of the two buss cables 118 may be configured such that each buss cable 118 connects to a dual stage cam assembly 200 and a limb 116 on opposite sides of dual stage compound bow 100.

Referring now to FIGS. 2A, 2B, 3 and 4, dual stage cam assembly 200 is illustrated, in accordance with various embodiments. Dual stage cam assembly 200 may be configured to be coupled between and rotate relative to limbs 116. Dual stage cam assembly 200 may comprise a main cam 202 configured to rotate in response to a user pulling a drawstring, such as drawstring 120, for example. As will be apparent below, dual stage cam assembly 200 may comprise a number of concentric cam elements configured to rotate at varying degrees upon drawing of a drawstring.

Main cam 202 may be configured to house a charge cam 204 and a shoot cam 206 in various embodiments. Charge cam 204 and shoot cam 206 may be configured to rotate with main cam 202 as a drawstring is being pulled by a user, thereby rotating main cam 202 relative to limbs 116. Charge cam 204 may comprise a substantially cylindrical shape comprising a lock notch 208 located on an outer surface of charge cam 204 and pawl notches 210 located on the rounded edges of charge cam 204. Charge cam 204 may further comprise an unlocking protrusion 212 located on an outer surface of charge cam 204.

Charge cam 204 may be coupled to and configured to rotate about a cylindrical fixed keyed plate 214. As charge cam 204 rotates, fixed keyed plate 214 remains stationary. In various embodiments, fixed keyed plate 214 may comprise a plurality of roller elements 216 configured to allow a charge cam cable 218 to move relative to fixed keyed plate 214. Charge cam cable 218 may be coupled to charge cam 204 at one end and coupled to shoot cam 206 at the other end. Roller elements 216 may comprise a plurality of posts with a corresponding number of spools which may rotate around the posts. In various embodiments, a charge cam cable node 220 may be configured to connect charge cam 204 with shoot cam 206. Specifically, charge cam cable node 220 may extend from a surface of shoot cam 206, through fixed keyed plate 214, and through an aperture in charge cam 204. Charge cam cable 218 may comprise an eye configured to wrap around charge cam cable node 220 between fixed keyed plate 214 and charge cam 204.

Dual stage cam assembly 200 may further comprise a shoot cam bearing 222 positioned radially outward of fixed keyed plate 214. Shoot cam bearing 222 may be configured to allow rotation of shoot cam 206 relative to fixed keyed plate 214. For example, shoot cam bearing 222 may comprise a roller bearing comprising a fixed inner annular ring, a rotating outer annular ring, and a number of roller elements configured to allow rotation of the rotating outer annular ring relative to the fixed inner annular ring.

In various embodiments, shoot cam 206 may be positioned radially outward of fixed keyed plate 214. As previously stated, shoot cam 206 may be configured to rotate relative to fixed keyed plate 214 upon rotation of main cam 202. Shoot cam 206 may be configured to rotate relative to main cam 202. For example, in various embodiments, a main cam bearing 224 may be positioned radially outward of shoot cam 206, but radially inward of main cam 202. Similar to shoot cam bearing 222, main cam bearing 224 may comprise a roller bearing. However, shoot cam bearing 222 and main cam bearing are not limited in this regard and may comprise any other suitable bearing mechanism capable of allowing rotation of main cam 202 relative to shoot cam 206 and rotation of shoot cam 206 relative to fixed keyed plate 214. Main cam 202, charge cam 204, shoot cam 206, fixed keyed plate 214, shoot cam bearing 222, and main cam bearing 224 may all be substantially aligned at a center of the components with a non-rotating keyed shaft 226 extending through a central aperture of fixed keyed plate 214.

Dual stage cam assembly 200 may comprise a main cam spring 228 configured to urge main cam 202 in a direction such that the drawstring remains taught when the bow is in a rest position. Specifically, dual stage cam assembly 200 may comprise a main cam spring pin 230 configured to interface with main cam spring 228 and main cam 202. Main cam spring 228 may provide a bias force to main cam 202 through main cam spring pin 230 such that main cam 202 is biased to rotate to maintain tension on drawstring 120.

Dual stage cam assembly 200 may be coupled on one end to limb 116 via a limb end housing 232. Limb end housing 232 may be configured to be fastened to a terminal end of limb 116 and also fastened to dual stage cam assembly 200. In various embodiments, limb end housing 232 may be coupled to limb 116 and/or dual stage cam assembly 200 utilizing one or more bolts, rivets, screws or the like. In various embodiments, an adjustable draw length shoot cam profile 234 may be situated between limb end housing 232 and dual stage cam assembly 200. For example, adjustable draw length shoot cam profile 234 may be fastened to limb end housing 232 and/or various components of dual stage cam assembly 200. A user may toggle adjustable draw length shoot cam profile 234 in order to customize a desired draw length by customizing the amount of travel allowed by buss cables 118 as main cam 202 rotates.

In various embodiments, main cam 202 may comprise a substantially circular portion 236 and a substantially ovoid portion 238 radially outward of circular portion 236. Ovoid portion 238 may comprise a channel on a radially outer edge of main cam 202 configured to receive a drawstring, such as drawstring 120. Main cam 202 may be configured to be coupled to a main cam pawl 240 which may be coupled to a radially outer portion of circular portion 236, in various embodiments. For example, main cam 202 and main cam pawl 240 may each comprise a raised portion containing an aperture configured to receive a main cam pawl shaft 242. Main cam pawl shaft 242 may be inserted through the apertures in the respective raised portions of main cam 202 and main cam pawl 240 and couple the components together.

In various embodiments, main cam pawl 240 may be configured to engage shoot cam 206. Main cam pawl 240 may contain a main cam pawl spring 244 configured to bias main cam pawl 240 in an engaged and disengaged position relative to shoot cam 206. For example, main cam pawl 240 may be configured to rotate about main cam pawl shaft 242. Main cam pawl 240 may rotate in a clockwise direction to be disengaged and may rotate in a counterclockwise direction to be engaged. In various embodiments, main cam pawl 240 may be configured to prevent counter rotation of shoot cam 206 at a second fully drawn position. Because main cam pawl 240 may be coupled to shoot cam 206 and main cam 202, main cam pawl may be further configured to transfer stored energy in limbs 216 to drawstring 120, as will be discussed further below.

Charge cam 204 may be configured to interact with a charge cam pawl 246, in various embodiments. Charge cam pawl 246 may be mounted to an inner surface of main cam 202 and may be configured to interact with charge cam 204 such that charge cam 204 may be engaged to allow rotation or disengaged to prevent rotation. In such a way, depending the position of charge cam pawl 246, charge cam pawl 246 may act as a mechanical stop for charge cam 204 and prevent charge cam 204 from releasing stored energy through counter rotation. Ball detent 248 may contact a portion of charge cam pawl 246 such that charge cam pawl 246 is disengaged from charge cam 204. For example, ball detent 248 may comprise a spring element and ball situated within a cylinder and configured bias charge cam pawl 246 such that charge cam pawl 246 remains disengaged from charge cam 204. In various embodiments, a charge cam pawl spring arm 250 may be configured to urge charge cam pawl 246 to engage charge cam 204. Accordingly, charge cam pawl 246 may be biased toward a disengage position via ball detent 248 and biased toward an engaged position via charge cam pawl spring arm 250.

In various embodiments, charge cam pawl 246 may comprise a charge cam pawl rod 252 extending outwardly from charge cam pawl 246. Charge cam pawl rod 252 may comprise a flexible material such as a polymer having a substantially cylindrical shape. Charge cam pawl rod 252 may be configured to be toggled by a user such that charge cam pawl may be moved from an engaged position to a disengaged position or vice versa. When engaged, charge cam pawl 246 may allow forward rotation of charge cam 204 and prevent reverse rotation of charge cam 204.

Charge cam 204 may house a charge cam spring 254 at an inner surface of charge cam 204. Charge cam spring 254 may be a torsion spring configured to provide a bias force to charge cam 204 such that charge cam 204 desires to rotate and maintain tension on charge cam cable 218. Charge cam 204 may further house one or more bearings 256 located near a center of charge cam 204 and radially outward of non-rotating keyed shaft 226 to allow charge cam 204 to rotate relative to the non-rotating keyed shaft 226.

Charge cam 204 may further be configured to receive a charge cam lock arm 258, which may be configured to allow/disallow rotation of charge cam 204, in accordance with various embodiments. Charge cam lock arm 258 may comprise a substantially cylindrical shaped component comprising a notch 260 located near a center of charge cam lock arm 258. Charge cam lock arm 258 may be configured to be inserted into lock notch 208 formed on an outer surface of charge cam 204 such that counter rotation of charge cam is prevented. In various embodiments, charge cam 204 may comprise a charge cam lock arm spring 262 configured to bias charge cam lock arm 258 in a direction toward charge cam 204.

Charge cam 204 may be coupled to a lock arm release button 264. Specifically, lock arm release button 264 may be coupled to and configured to rotate about a rod extending from an outer surface of charge cam 204. A lock arm release button spring 268 may provide a bias force to lock arm release button 264 such that lock arm release button 264 desires to maintain contact with charge cam lock arm 258 in notch 260. In response to a counter force being applied to lock arm release button 264 in the rotationally opposite direction of a force applied by the lock arm release button spring 268, lock arm release button 264 may no longer contact notch 260, and charge cam lock arm 258 may move in a direction toward charge cam 204.

Dual stage cam assembly 200 may further comprise a charge cam pawl unlocking component 266. Charge cam pawl unlocking component 266 may be fastened to an inner surface of limb end housing 232 and be configured to disengage charge cam pawl 246, in various embodiments. Specifically, as charge cam pawl 246 and charge cam 204 rotate, charge cam pawl rod 252 attached to charge cam pawl 246 may approach static charge cam pawl unlocking component 266. Charge cam pawl unlocking component 266 may force the flexible charge cam pawl rod 252 away from a center of charge cam 204, thereby disengaging charge cam pawl 246 from charge cam 204.

Figure 4:
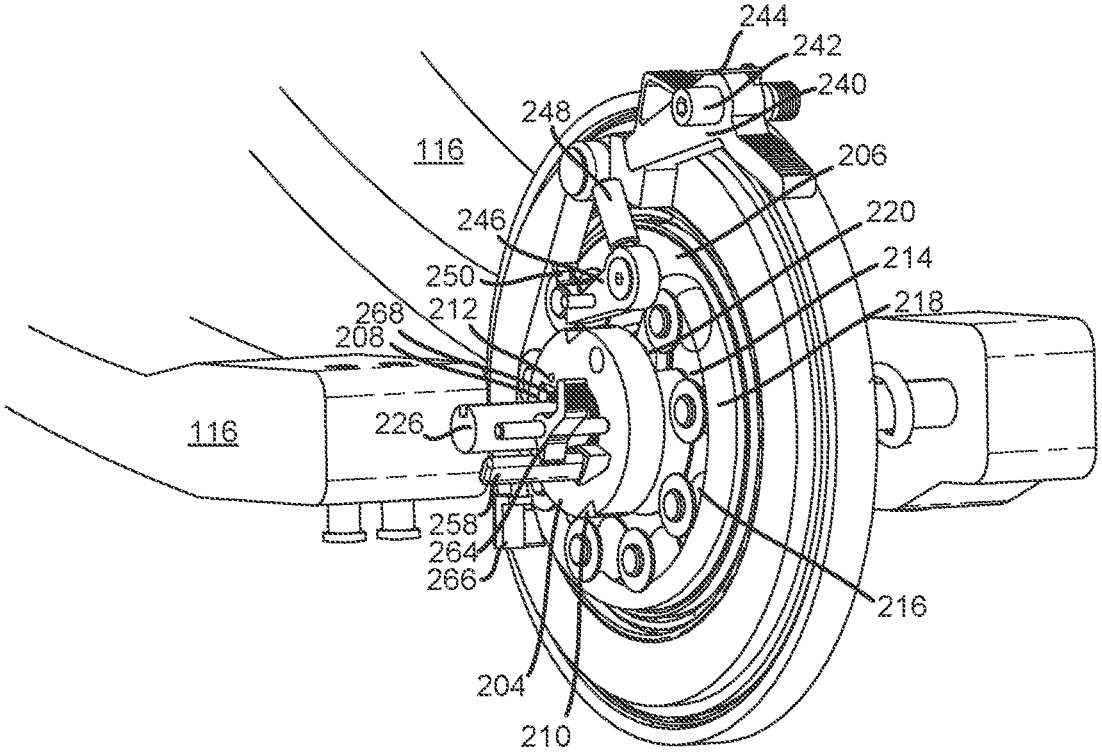
FIG. 4 illustrates a perspective view of a partially constructed dual stage cam assembly at a first rest position, in accordance with various embodiments.
Figure 5A:
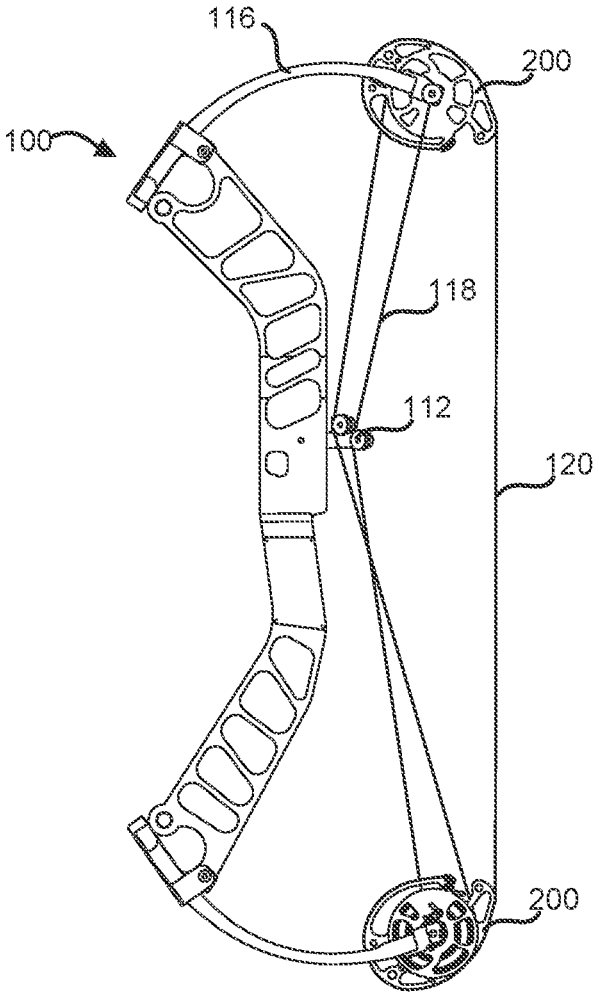
FIGS. 5A and 5B illustrate a side view of a dual stage compound bow and a side view of a dual stage cam assembly at a first rest position, respectively, in accordance with various embodiments.
Figure 5B:
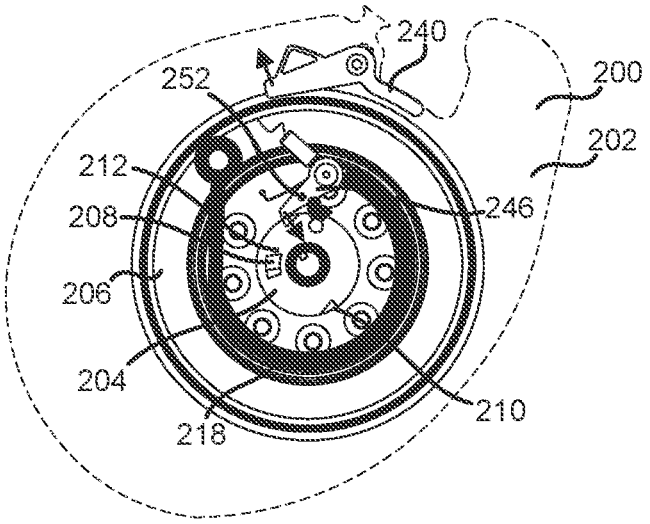

Now that the various components of dual stage cam assembly have been introduced, a function of dual stage cam assembly 200 may be described. Specifically, referring now to FIGS. 5A and 5B (in addition to FIGS. 3 and 4 throughout a remainder of this description), dual stage compound bow 100 and a corresponding position of dual stage cam assembly 200 are illustrated in a first rest position, in accordance with various embodiments. FIG. 4 illustrates dual stage cam assembly 200 in a rest position without main cam 202 or limb end housing 232 for ease of illustration.

As will be apparent from the below, dual stage compound bow 100 may reduce the draw weight of the bow via two stages. Dual stage cam assembly 200 may be configured to store half of the potential energy of the bow in response to retracting drawstring 120 to a first fully drawn position and store half of the potential energy of the bow in response to retracting drawstring again to a second fully drawn position. Together, the first fully drawn position and second fully drawn position may provide for the total kinetic output energy of the system, which may be approximately twice the potential energy stored from the first fully drawn position or the second fully drawn position.

Before drawstring 120 is pulled for a first time, a user may toggle lock arm release button 264 such that charge cam lock arm 258 may move toward charge cam 204. In such a way, charge cam lock arm 258 may be configured to move along outer surface of charge cam 204 as charge cam 204 rotates. A user may also toggle charge cam pawl 246 to an engaged position via charge cam pawl rod 252. Charge cam pawl 246 may be positioned in pawl notch 210 of charge cam 204 such that charge cam pawl 246 may rotate charge cam 204 without slipping. Finally, a user may disengage main cam pawl 240 such that shoot cam 206 may be free to rotate.

As drawstring 120 is pulled by the user, drawstring 120 may pull on main cam 202 and cause main cam 202 to rotate in a counterclockwise direction. In turn, charge cam pawl 246 may rotate with main cam 202 and cause rotation of charge cam 204. As charge cam 204 continues to rotate, charge cam may cause rotation of shoot cam 206 via charge cam cable 218. Specifically, as charge cam 204 rotates, charge cam cable 218 may become tensioned due to the static nature of shoot cam 206 and begin rotating in a counterclockwise direction as charge cam 204 continues to rotate. Accordingly, each of the main cam 202, charge cam 204, and shoot cam 206 may be rotating together as drawstring 120 is being pulled toward a first fully drawn position.

Figure 6A:
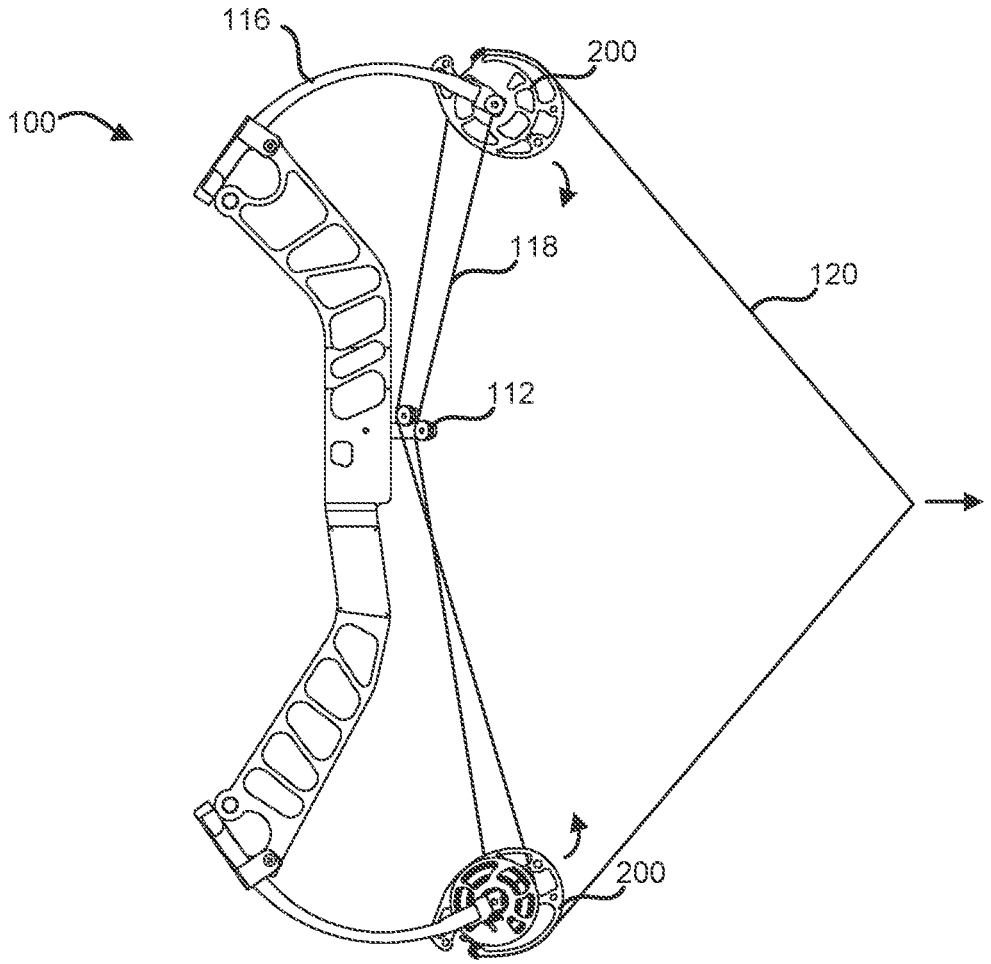
FIGS. 6A and 6B illustrate a side view of a dual stage compound bow and a side view of a dual stage cam assembly at a first fully drawn position, respectively, in accordance with various embodiments.
Figure 6B:
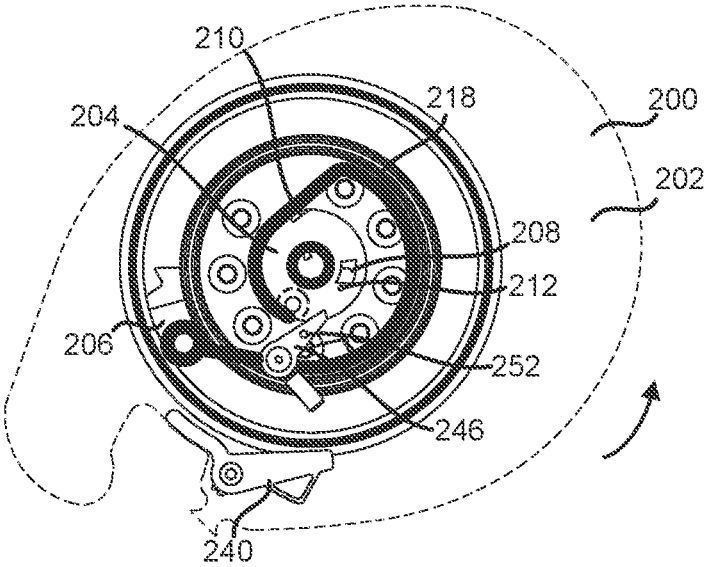
Figure 7A:
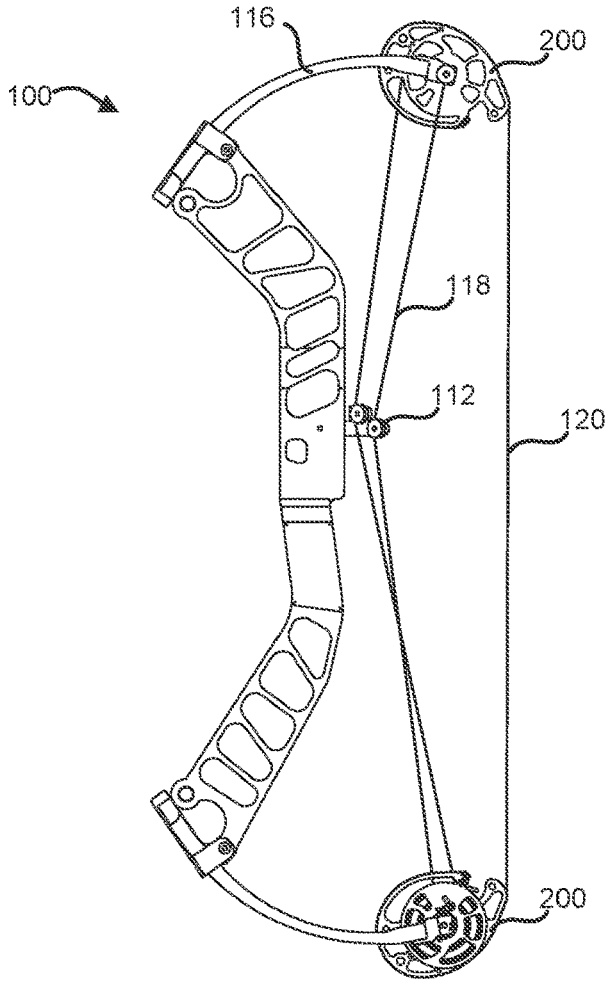
FIGS. 7A and 7B illustrate a side view of a dual stage compound bow and a side view of a dual stage cam assembly at a second rest position, respectively, in accordance with various embodiments.
Figure 7B:
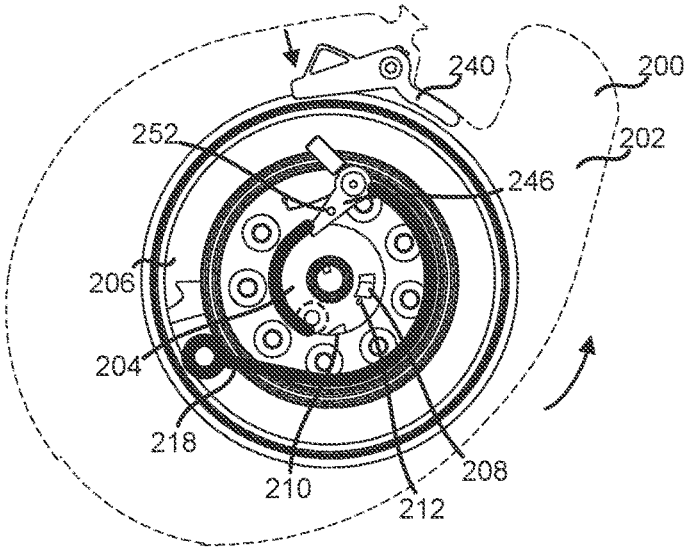

Referring now to FIGS. 6A and 6B, dual stage compound bow 100 and dual stage cam assembly 200 are illustrated in a first fully drawn position, in accordance with various embodiments. As charge cam 204 continues to rotate towards the first fully drawn position, a position of lock notch 208 on the outer surface of charge cam 204 will rotate with charge cam 204 such that lock notch approaches a position of charge cam lock arm 258. Upon arriving at the first fully drawn position, charge cam lock arm 258 and lock notch 208 will align and charge cam lock arm 258 will be inserted into lock notch 208 due to charge cam lock arm spring 262 biasing charge cam lock arm in the direction of charge cam 204. Charge cam lock arm 258 will lock charge cam 204 in place such that charge cam 204 will be prevented from counter rotating in response to forces resulting from limbs 116 urging to return to an undeformed position. At this stage, limbs 116 will have traveled approximately half of an overall travel distance to fully charge the bow.

After reaching the first fully drawn position, the dual stage cam assembly 200 may be locked in position and a user may return drawstring 120 to the rest position. Accordingly, referring now to FIGS. 7A and 7B, dual stage compound bow 100 and dual stage cam assembly 200 are illustrated at a second rest position. As previously stated, at this stage, limbs 116 have traveled half the intended distance required to achieve a desired output energy and dual stage cam assembly 200 is in a locked position. As such, half the desired energy is stored in limbs 116. At this stage, a user may begin to prepare for his/her shot, notch an arrow in drawstring 120, and begin the second pull. However, before beginning the second pull, a user may engage main cam pawl 240 by rotating main cam pawl 240 about main cam pawl shaft 242 in a counterclockwise direction. As will be discussed further below, such a configuration will allow main cam pawl 240 to interact with one or more notches formed on an outer edge of shoot cam 206.

As drawstring 120 is pulled during the second pull, main cam 202 may continue to rotate, thereby also rotating charge cam 204 and shoot cam 206. Charge cam lock arm 258, previously positioned in lock notch 208, may begin to travel along a ramp located in lock notch 208 and extending toward outer surface of charge cam 204. Accordingly, charge cam lock arm 258 will be forced outward such that it again contacts the outer surface of charge cam 204. As charge cam 204 continues to rotate, charge cam lock arm 258 may contact unlocking protrusion 212 which may force charge cam lock arm away from charge cam 204, allowing charge cam lock arm 258 to move past lock arm release button due to the presence of notch 260 in charge cam lock arm 258. As such, charge cam 204 may continue to rotate, allowing drawstring 120 to continue to be pulled.

Figure 8A:
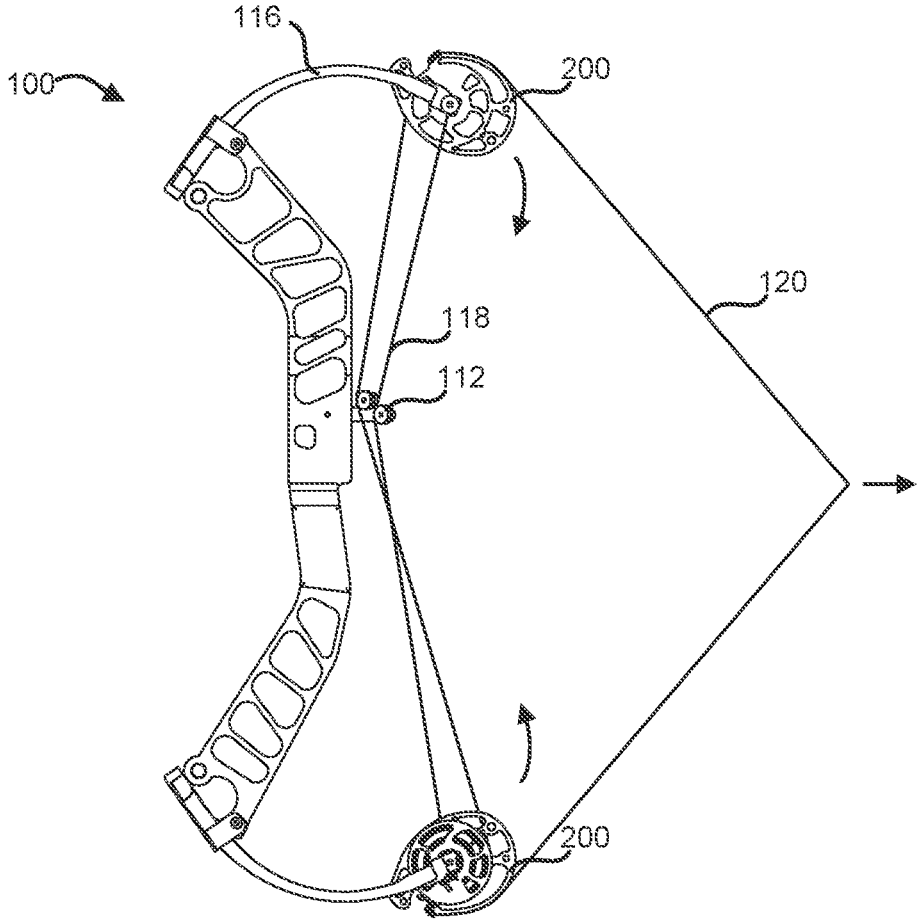
FIGS. 8A and 8B illustrate a side view of a dual stage compound bow and a side view of a dual stage cam assembly at a second fully drawn position, respectively, in accordance with various embodiments.
Figure 8B:
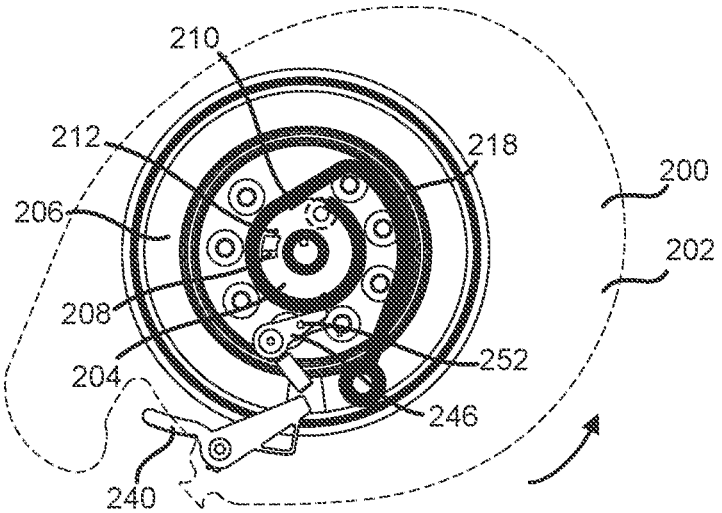

Referring now to FIGS. 8A and 8B, dual stage compound bow 100 and dual stage cam assembly 200 are illustrated in a second fully drawn position, in accordance with various embodiments. As the second pull continues, main cam 202, charge cam 204, and shoot cam 206 will continue to rotate in a common direction. Before dual stage compound bow 100 reaches the second fully drawn position, main cam pawl 240 (already contacting an outer edge of shoot cam 206), will lock into a notch formed on an outer edge of shoot cam 206. By doing so, pressure between charge cam pawl 246 and charge cam 204 will be relieved, allowing charge cam pawl 246 to be disengaged from charge cam 204. Specifically, as charge cam 204 and charge cam pawl 246 continue to rotate, charge cam pawl 246 will begin to approach charge cam pawl unlocking component 266. As charge cam pawl rod 252 contacts charge cam pawl unlocking component 266, charge cam pawl rod will flex radially outward, thereby disengaging charge cam pawl from charge cam 204. Ball detent 248, urging charge cam pawl 246 toward a disengaged position, may assist in disengaging charge cam pawl 246 from charge cam 204.

At this stage, limbs 116 will be fully compressed, with half of the compression resulting from the first pull and half of the compression resulting from the second pull. As such, limbs will have stored the full amount of energy required for the shot through two pulls of the drawstring, each pull charging the limbs 116 and dual stage compound bow 100 with half the energy desired. Accordingly, a user capable of only pulling 40 pounds of weight, for example, may be able to make two pulls of 40 pounds of weight, while the system may be capable of outputting an amount of energy equivalent to one 80-pound pull. As would be appreciated by one of skill in the art, the numbers above are for purposes of example only, and dual stage compound bow 100 is not limited in this regard and may be customized for various other draw weights and output velocities.

When the user is ready to fire, the user may release drawstring 120, thereby releasing the stored energy in the system through counter rotation of each of main cam 202, charge cam 204, and shoot cam 206. Specifically, main cam 202 and shoot cam 206 may be coupled together via main cam pawl 240, which may transfer all of the energy stored in limbs 116 to drawstring 120. As a result, energy stored in limbs 116 may be released, thereby returning to an undeformed position and forcing drawstring 120 toward the target. As drawstring 120 continues to move toward the target, drawstring 120 may project the arrow towards the target.

Figure 9:
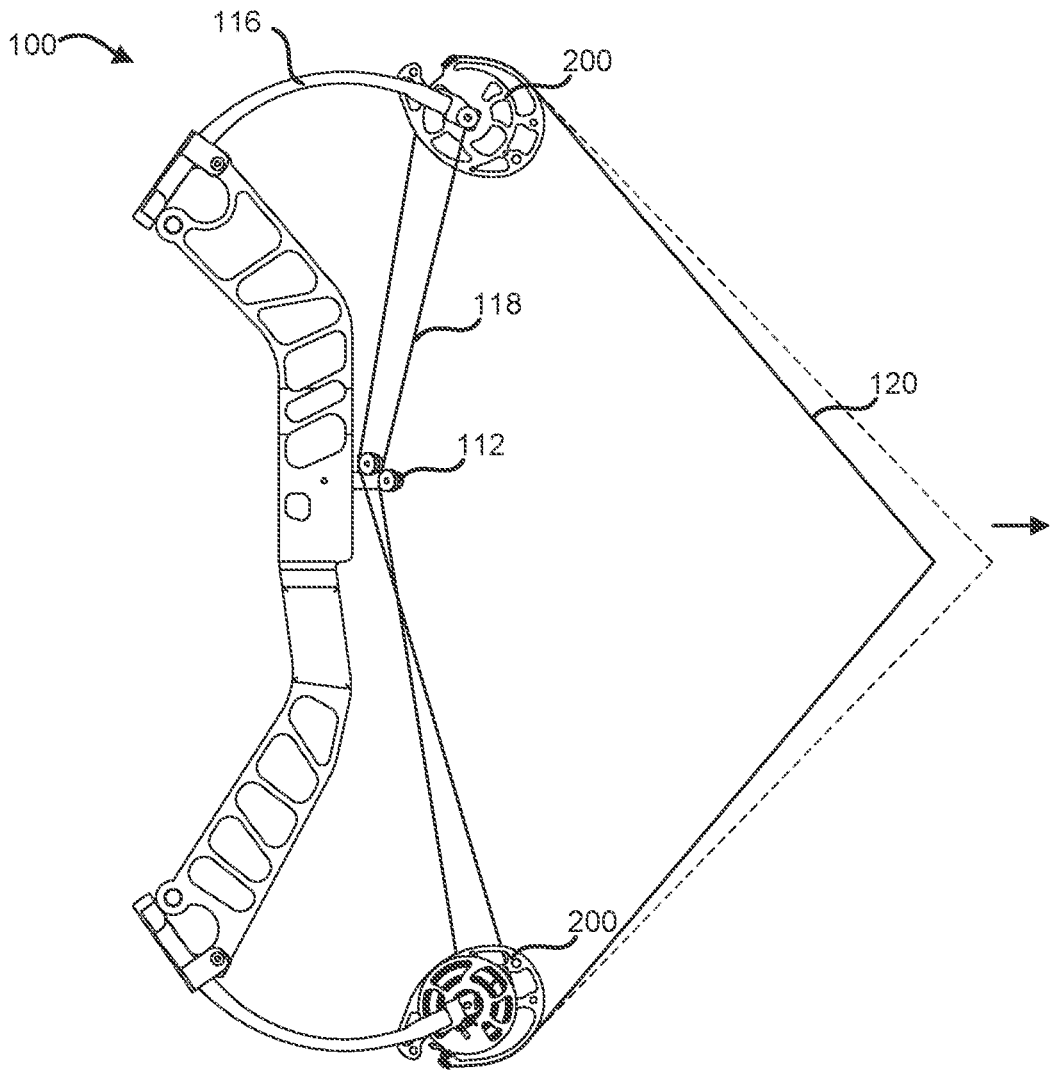
FIG. 9 illustrates a side view of a dual stage compound bow at an extended drawn position, in accordance with various embodiments.

Referring now to FIG. 9, dual stage compound bow 100 is illustrated in an extended draw position, in accordance with various embodiments. If a user is not prepared to fire dual stage compound bow 100 after reaching the second fully drawn position, the user need not release the stored energy resulting from the first pull. Specifically, a user may continue to pull drawstring 120 past the second fully drawn position to an extended position. By doing so, each of main cam 202, charge cam 204, and shoot cam 206 will continue to rotate. At a certain point in the extended pull, charge cam pawl rod 252 will move past charge cam pawl unlocking component 266. Charge cam pawl unlocking component 266 may urge charge cam pawl rod 252 toward charge cam 204 to prevent charge cam pawl 246 from being disengaged by ball detent 248 upon letdown of drawstring 120. Charge cam pawl spring arm 250 may also assist by urging charge cam pawl 246 to re-engage charge cam 204. Accordingly, a user may return drawstring 120 to a second rest position and re-initiate the second pull, when ready.

In various embodiments, charge cam 204 may comprise a diameter approximately half of a diameter of the outer surface of the plurality of roller elements 216 on fixed keyed plate 214. In such a way, shoot cam 206, which is connected to charge cam 204 via charge cam cable 218 wrapped around the plurality of roller elements 216, may be configured to rotate half as much as the charge cam 204 rotates during the same time period. For example, during the first pull, charge cam 204 may be configured to rotate approximately 180 degrees, while shoot cam 206 may be configured to rotate approximately 90 degrees. As a result, dual stage cam assembly 200 may be configured to store half the potential energy necessary for a desired output energy using two separate fully drawn pulls. However, dual stage cam assembly 200 is not limited in this regard and may comprise any suitable diameter ratio.

Figure 10:
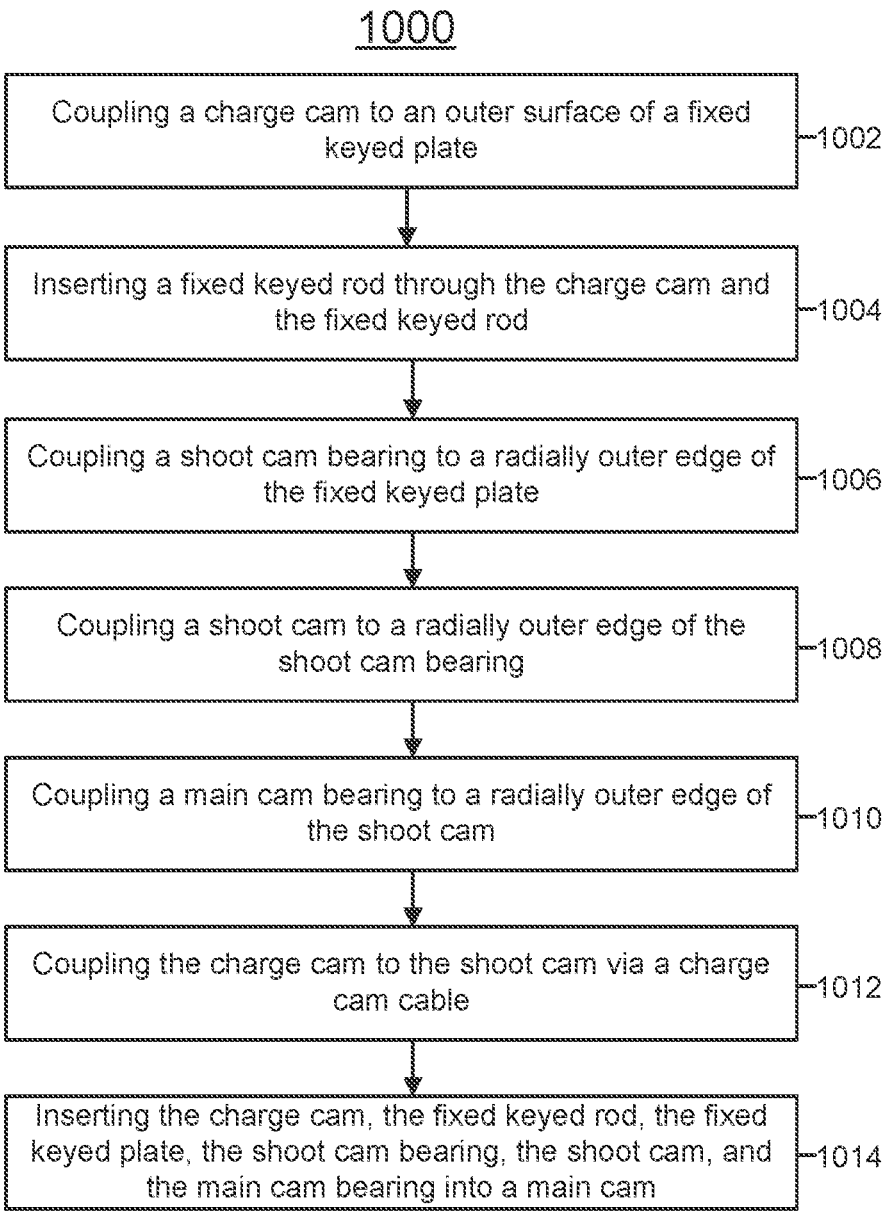
FIG. 10 illustrates a block diagram of a method of manufacturing a dual stage cam assembly, in accordance with various embodiments.

A block diagram illustrating a method of manufacturing a dual stage cam assembly 1000 is illustrated in FIG. 10, in accordance with various embodiments. In various embodiments, the method may comprise coupling a charge cam to an outer surface of a fixed keyed plate (step 1002). The method may further comprise inserting a fixed keyed rod through the charge cam and the fixed keyed rod (step 1004). The method may further comprise coupling a shoot cam bearing to a radially outer edge of the fixed keyed plate (step 1006). The method may further comprise coupling a shoot cam to a radially outer edge of the shoot cam bearing (step 1008). The method may further comprise coupling a main bearing to a radially outer edge of the shoot cam (step 1010). The method may further comprise coupling the charge cam to the shoot cam via a charge cam cable (step 1012). The method may further comprise inserting the charge cam, the fixed keyed rod, the fixed keyed plate, the shoot cam bearing, the shoot cam, and the main cam bearing into a main cam (step 1014).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods, apparatuses, and systems are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cam assembly for a compound bow, the cam assembly comprising:

a shoot cam; and a charge cam configured to be operatively coupled to the shoot cam; and a charge cam pawl configured to contact a notch in the charge cam;

wherein the cam assembly is configured to store a potential energy in response to a draw of a drawstring.

2. The cam assembly of claim 1, further comprising a charge cam pawl rod coupled to the charge cam pawl and configured to contact a charge cam pawl unlocking component to disengage the charge cam pawl from the charge cam.

3. The cam assembly of claim 2, further comprising a spring arm configured to contact the charge cam pawl and configured to urge the charge cam pawl to an engaged position with respect to the charge cam.

4. The cam assembly of claim 2, further comprising a ball detent coupled to the charge cam pawl and configured to urge the charge cam pawl to a disengaged position with respect to the charge cam.

5. The cam assembly of claim 2, wherein the charge cam pawl unlocking component is configured to force the charge cam pawl rod radially outward to disengage the charge cam pawl from the charge cam.

6. The cam assembly of claim 1, further comprising a charge cam cable, wherein the charge cam is configured to be operatively coupled to the shoot cam via the charge cam cable.

7. The cam assembly of claim 6, further comprising a fixed keyed plate, wherein the shoot cam and the charge cam are configured to rotate in a common direction with respect to the fixed keyed plate.

8. The cam assembly of claim 7, further comprising a plurality of roller elements coupled to the fixed keyed plate, wherein the plurality of roller elements is configured to allow the charge cam cable to move relative to the fixed keyed plate.

9. A compound bow, the compound bow comprising:

a charge cam cable; and a cam assembly comprising a shoot cam operatively coupled to a charge cam, wherein the cam assembly is configured to store a potential energy in response to a draw of a drawstring.

10. The compound bow of claim 9, wherein the charge cam is operatively coupled to the shoot cam via the charge cam cable.

11. The compound bow of claim 10, further comprising a fixed keyed plate.

12. The compound bow of claim 11, wherein the shoot cam and the charge cam are configured to rotate with respect to the fixed keyed plate.

13. The compound bow of claim 12, further comprising a plurality of roller elements coupled to the fixed keyed plate.

14. The compound bow of claim 13, wherein the charge cam cable is wrapped around the plurality of roller elements.

15. The compound bow of claim 9, further comprising a drawstring coupled to the cam assembly and configured to rotate the cam assembly to store the potential energy.

16. A compound bow, comprising:

a shoot cam; and a charge cam operatively coupled to the shoot cam;

wherein the charge cam is configured to rotate to a locked position to store a potential energy in response to a draw of a drawstring.

17. The compound bow of claim 16, further comprising a charge cam cable.

18. The compound bow of claim 17, wherein a first end of the charge cam cable is coupled to the shoot cam and a second end of the charge cam cable is cabled to the charge cam.

19. A cam assembly for a compound bow, the cam assembly comprising:

a charge cam cable;

a shoot cam; and a charge cam configured to be operatively coupled to the shoot cam via the charge cam cable;

wherein the cam assembly is configured to store a potential energy in response to a draw of a drawstring.

20. The cam assembly of claim 19, further comprising a fixed keyed plate, wherein the shoot cam and the charge cam are configured to rotate in a common direction with respect to the fixed keyed plate.

* * * * *